United States Patent [19]

Yan

[11] Patent Number: 4,469,032

[45] Date of Patent: Sep. 4, 1984

[54] ZONE COMBUSTION OF HIGH SULFUR COAL TO REDUCE $SO_x$ EMISSION

[75] Inventor: Tsoung Y. Yan, Philadelphia, Pa.

[73] Assignee: Mobil Oil Corporation, New York, N.Y.

[21] Appl. No.: 419,106

[22] Filed: Sep. 16, 1982

[51] Int. Cl.[3] ..... F23B 7/00

[52] U.S. Cl. ..... 110/342; 110/344; 110/345; 110/347

[58] Field of Search ..... 110/344, 345, 229, 347, 110/342; 48/101, 210, 197 R

[56] References Cited

U.S. PATENT DOCUMENTS

| | | | |
|---|---|---|---|
| 3,599,610 | 8/1971 | Spector | 110/229 X |
| 3,727,562 | 4/1973 | Bauer . | |
| 3,736,233 | 5/1973 | Sass et al. . | |
| 4,052,170 | 10/1977 | Yan . | |
| 4,077,866 | 3/1978 | Yan . | |
| 4,118,201 | 10/1978 | Yan . | |
| 4,245,573 | 1/1981 | Dixit et al. . | |
| 4,246,853 | 1/1981 | Metha | 110/344 X |
| 4,253,409 | 3/1981 | Wormser | 110/229 X |
| 4,256,703 | 3/1981 | Dixit et al. . | |
| 4,285,283 | 8/1981 | Lyon et al. | 110/229 X |
| 4,306,506 | 12/1981 | Rotter | 110/229 |
| 4,322,218 | 3/1982 | Nozaki . | |
| 4,335,660 | 6/1982 | Maloney et al. | 110/344 X |

OTHER PUBLICATIONS

"Sulfur Dioxide Emission Control by Hydrogen Sulfide Reaction in Aqueous Solution", Bureau of Mines Report of Investigations/1973, R.I. 7774, United States Department of the Interior.

*Primary Examiner*—Edward G. Favors

*Attorney, Agent, or Firm*—Alexander J. McKillop; Michael G. Gilman; Charles J. Speciale

[57] ABSTRACT

In the combustion of high sulfur coal, $SO_x$ emission is reduced by pyrolizing the coal in a reducing atmosphere to form char and convert the sulfur compounds to combustible gases including $H_2S$. The $H_2S$ is reacted with the coal and the char to produce ash containing sulfur which is easily removed from the combustion process. A three zone furnace includes a zone in which the coal is pyrolized in a reducing atmosphere to convert the sulfur compounds to combustible gas which reacts with the coal and char.

12 Claims, 1 Drawing Figure

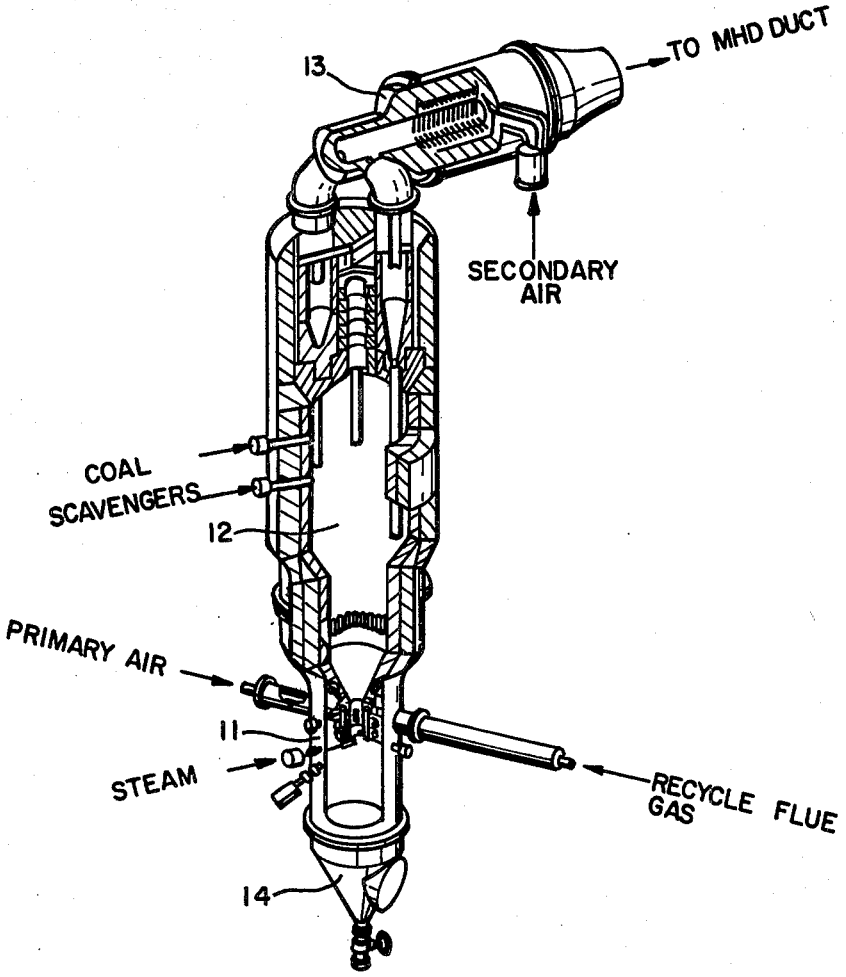
TO MHD DUCT
13
SECONDARY AIR
COAL
SCAVENGERS
12
PRIMARY AIR
11
STEAM
RECYCLE FLUE GAS
14

ZONE COMBUSTION OF HIGH SULFUR COAL TO REDUCE $SO_x$ EMISSION

BACKGROUND OF THE INVENTION

This invention relates to a method of reducing the $SO_x$ emission in the combustion of coal which contains sulfur compounds and more particularly, to a three zone furnace for burning high sulfur coal.

The use of coal for the generation of power and the like is increasingly important as supplies of hydrocarbons become scarce. The use of coal has been limited by the high sulfur content of much coal. When burned, high sulfur coal produces $SO_3$ and $SO_2$ which have an adverse environmental impact.

Attempts to minimize this impact have included extensive cleaning of the sulfur coals prior to burning. For example, in U.S. Pat. No. 4,052,170-Yan, paramagnetic impurities including sulfur compounds are magnetically separated from the coal before burning. U.S. Pat. Nos. 4,077,866 Owen, Venuto and Yan and 4,118,201-Yan show other techniques for producing low sulfur fuel from coal.

Another approach is to remove $SO_3$ and $SO_2$ from the flue gas emitted from the furnace. Some of the techniques for accomplishing this are described in "SULFUR DIOXIDE EMISSION CONTROL BY HYDROGEN SULFIDE REACTION IN AQUEOUS SOLUTION," Bureau of Mines Report of Investigations/1973, R. I. 7774, United States Department of the Interior.

Desulfurization has also been practiced during the conversion of coal to its volatile components, an example of which is shown in U.S. Pat. Nos. 3,736,233 Sass et al., in 4,253,409 Warmser and 3,727,562 Bauer.

The equipment which is required to separate the sulfur from the coal prior to burning and to collect $SO_x$ emissions from the flue gas is very expensive. This has limited the use of these approaches to controlling $SO_x$ emission.

Another approach which does not require the use of expensive equipment is to add scavengers to the coal. See U.S. Pat. Nos. 4,245,573-Dixit et al, 4,256,703-Dixit et al and 4,322,218-Nozaki. It is known that a significant amount of sulfur will be retained in the ash if the coal contains basic minerals, such as calcium carbonate, dolomite, or soda ash. These basic minerals act as scavengers which trap the $SO_x$, preventing its emission, and facilitating removal with the ash.

It is an object of the present invention to improve the trapping efficiency of sulfur scavengers, both indigenous in the coal or added to it.

In accordance with the present invention a, multiple stage combustion furnace is operated in a manner which facilitates the removal of ash containing sulfur from the combustion process.

SUMMARY OF THE INVENTION

In accordance with the present invention, the coal is pyrolized in a reducing atmosphere to convert the sulfur compounds to combustible gases including $H_2S$. The $H_2S$ is effectively trapped in the basic minerals contained in the indigenous coal or in the added scavengers. I have found that the trapping of sulfur compounds in the ash is performed more efficiently by my invention than in the direct combustion of coal.

A three zone furnace is used to practice the invention. In the first, lower zone, char is combusted in an oxidizing atmosphere, at high temperature to achieve complete combustion and high carbon utilization. Primary air supplied to the first zone is restricted so that little or no excess oxygen reaches the second zone, which is above the first. In the second zone, the coal is pyrolized to form char and combustible gases in a reducing atmosphere. In this zone the sulfur compounds in the coal are converted to highly reactive $H_2S$. This $H_2S$ reacts with the basic minerals in the coal which is added to the second stage. It also reacts with the char produced in the first stage to produce ash in which the sulfur compounds are trapped. Basic mineral scavengers such as limestone and dolomite are added to the second stage to further trap the hydrogen sulfide. The furnace has a third zone, above the second zone, in which the combustible gas from the second zone is completely combusted by the introduction of secondary air. Any $H_2S$ which escapes from the second zone is converted into $SO_x$ and is emitted as flue gas.

The foregoing and other objects, features and advantages of the invention will be better understood from the following more detailed description and appended claims.

SHORT DESCRIPTION OF THE DRAWING

The drawing shows a three zone furnace which is suitable for practicing the invention.

DESCRIPTION OF THE PREFERRED EMBODIMENT

The drawing shows a furnace of the type shown in FIG. 20.52 of "Chemistry of Coal Utilization", National Research Council Committee on Chemical Utilization of Coal, H. H. Lowry, Chairman and Editor, New York, Wiley, 1945.

It includes a first zone 11 in which char is combusted at the highest temperature to achieve complete combustion and high carbon utilization. In accordance with the present invention, the flow of primary air to the first zone is controlled so that very little, preferably no excess oxygen reaches the second zone 12. In zone 12 the coal is pyrolized to form char and combustible gas in a reducing atmosphere. The temperature in this zone is above 500° C. and preferably above 600° C. Coal is added to the top of zone 12. The sulfur compounds in the coal, e.g., $FeS_2$ and disulfide, are converted to highly reactive $H_2S$ in accordance with:

$$FeS_2+H_2 \rightarrow FeS+H_2S$$

$$FeS+H_2 \rightarrow Fe+H_2S$$

$$RSR'+2H_2 \rightarrow H_2S+RH+R'H$$

In the foregoing R and R' are alkyl groups which are present in the coal.

To enhance this reaction, a small amount of steam is added at the bottom of zone 11 to produce some hydrogen according to the following reaction:

$$C+H_2O \leftarrow CO+H_2$$

In zone 12, the $H_2S$ reacts with basic minerals in the coal, $CaCO_3$ or $MgCO_3$, as follows:

$$CaCO_3+H_2S \rightarrow CaS+CO_2+H_2O$$

$$MgCO_3+H_2S \rightarrow MgS+CO_2+H_2$$

Alternately, limestone added as a scavenger to second zone 12 is decomposed to active lime before reaction.

$$CaCO_3 \rightarrow CaO + CO_2$$

$$CaO + H_2S \rightarrow CaS + H_2O$$

At least part of the CaS or MgS formed in the char is further oxidized to sulfates in the first zone 11:

$$CaS + 2O_2 \rightarrow CaSO_4$$

$$MgS + O_2 \rightarrow MgSO_4$$

In this way, the sulfur is effectively trapped. The ash containing the trapped sulfur is easily removed from the slag quench tank 14 at the bottom of zone 11. This process is more efficient than direct combustion of coal in which the following typical reactions occur:

$$C + H_2O \leftarrow CO + H$$

$$2FeS_2 + \tfrac{1}{2}O_2 \rightarrow Fe_2O_3 + 4SO_2$$

$$CaCO_3 + SO_2 + \tfrac{1}{2}O_2 \rightarrow CaSO_4 + CO_2$$

The difference in efficiency is shown in the examples in the next section.

The combustible gas from zone 12 is completely combusted in the third zone 13 by introducing secondary air. Any $H_2S$ which survived through zone 12 due to insufficient or unavailability of scavenger is converted into $SO_x$ in zone 13 and emitted. To circumvent this problem, additional scavengers such as limestone or dolomite are introduced along with the coal into the top of zone 12.

To demonstrate the validity of the process, coal was pyrolized in $H_2$ or He gas at various temperatures to obtain the char. The char was combusted and compared with direct combustion of the coal for $SO_2$ emission.

The coal analysis is shown in Tables 1, 2 and 3. Table 1 shows proximate and ultimate analyses. Table 2 shows analysis of mineral matter. It is noted that this coal is quite rich in $CaCO_3$ and $MgCO_3$. Table 3 shows sulfur type distribution.

The experimental conditions, sulfur contents of the products and the $SO_2$ emission from combustion of char are shown in Table 4. It is noted that, in spite of the high sulfur content of the char, very low sulfur was emitted upon combustion. The pyrolysis can be conducted in $H_2$ or He with the same result; apparently there is sufficient $H_2$ in the pyrolysis zone from this particular coal.

TABLE 1

| Coal Analysis (wt %) | | | |
|---|---|---|---|
| Proximate analysis | | Ultimate analysis (mf) | |
| Moisture | 6.0 | C | 63.2 |
| Ash (mf) | 12.9 | H | 3.7 |
| VM (maf) | 56.4 | N | 1.8 |
| | | O | 14.1 |
| | | S | 4.3 |
| | | Ash | 12.9 |
| | | Total | 100.1 |

TABLE 2

| Mineral Matters (wt % mf) | | | | |
|---|---|---|---|---|
| (a) analyzed | | | (b) calculated | |
| $CaCO_3$ | 7.3 | | ASTM formula | 14.4 |
| $MgCO_3$ | 2.9 | | Parr formula | 16.3 |
| $CaSO_4 \cdot 2H_2O$ | 1.7 | | | |
| $SiO_2$ | 0.6 | | | |
| $Al_2O_3$ | 0.2 | | | |
| $Fe_2O_3$ | 0.6 | | | |
| $FeS_2$ | 0.7 | | | |
| Total | 14.0 | | | |

TABLE 3

| Sulfur Distribution | | |
|---|---|---|
| | wt % mf | % |
| Sulfate | 0.32 | 7.4 |
| Pyritic | 0.36 | 8.4 |
| Organic | 3.63 | 84.2 |
| Total | 4.31 | 100.0 |

TABLE 4

| Pyrolysis Conditions | | | Products: Sulfur Content, wt % | | | $SO_2$ Emission From Combustion of Char |
|---|---|---|---|---|---|---|
| T (°C.) | p (MPa) | Gas | Char | Oil | Gases[1] | (kg/t coal) |
| 589 | 1 | $H_2$ | 3.17 | 3.92 | 11.43 | 8.0 |
| 616 | 3 | $H_2$ | 3.25 | 2.38 | 13.37 | 7.8 |
| 780 | 3 | $H_2$ | 3.95 | 2.99 | 6.19 | 7.8 |
| 838 | 3 | $H_2$ | 4.73 | 3.03 | 4.99 | 7.8 |
| 845 | 3 | $H_2$ | 4.61 | 2.89 | 5.04 | 6.8 |
| 540 | 3 | He | 3.57 | 3.77 | 11.63 | 8.3 |
| Untreated coal | | | 4.30 | — | — | 55.5 |

[1]By sulfur balance

While a particular embodiment of the invention has been shown and described, various modifications are within the true spirit and scope of the invention. The appended claims are, therefore, intended to cover all such modifications.

What is claimed is:

1. The method of reducing $SO_x$ emission in the combustion of coal which contains sulfur compounds comprising:

combusting coal and char in an oxidizing atmosphere at high temperature;

pyrolizing said coal in a reducing atmosphere to form said char and to convert said sulfur compounds to combustible gas including $H_2S$;

restricting the flow of air to said coal during combusting to minimize the excess oxygen present during the step of pyrolizing;

adding steam during the step of combusting to produce hydrogen;

supplying said hydrogen to said pyrolizing step;

adding a basic mineral scavenger during pyrolizing;

reacting said $H_2S$ with a basic mineral in said coal, said scavenger and said char to produce ash containing sulfur; and removing said ash containing sulfur from the combustion process.

2. The method recited in claim 1 further comprising:

introducing secondary air; and combusting the unreacted combustible gas from the pyrolizing step.

3. The method recited in claim 1 wherein said basic mineral includes calcium carbonate and magnesium carbonate and the reaction is:

$$CaCO_3+H_2S \rightarrow CaS+CO_2+H_2O$$

$$MgCO_3+H_2S \rightarrow MgS+CO_2+H_2O$$

4. The method recited in claim 1 wherein said basic mineral scavenger is calcium carbonate.

5. The method recited in claim 1 wherein said basic mineral scavenger is dolomite.

6. The method recited in claim 1 wherein said basic mineral scavenger is soda ash.

7. The method recited in claim 1 wherein the step of pyrolizing is carried out at a temperature above 500° C.

8. The method recited in claim 1 wherein the step of pyrolizing is carried out at a temperature of approximately 600° C.

9. A method of operating a furnace for the combustion of coal, containing sulfur compounds, with reduced $SO_x$ emission comprising:

supplying primary air to a first zone in said furnace for combustion of materials in said first zone;

maintaining a reducing atmosphere in a second zone in said furnace above said first zone for pyrolizing coal supplied to said second zone forming char in said second zone;

adding steam to said first zone to produce hydrogen during combustion;

supplying said hydrogen to said second zone during pyrolizing;

converting said sulfur compounds to combustible gas in said second zone, said combustible gas including $H_2S$:

supplying a basic mineral scavenger to said second zone;

reacting with $H_2S$ with said coal, said scavenger and said char in said second zone to produce ash containing sulfur;

supplying said char to said first zone for combustion; and removing said ash containing sulfur from said furnace.

10. The method recited in claim 9 further comprising:

supplying secondary air to a third zone in said furnace above said second zone for combustion of said combustible gas from said second zone.

11. The method recited in claim 9 further comprising:

removing said ash from said first zone, said sulfur compounds being fixed in said ash.

12. The method recited in claim 10 further comprising:

removing flue gas from said third zone.

* * * * *